US007530848B2

(12) United States Patent
Nagashima et al.

(10) Patent No.: US 7,530,848 B2
(45) Date of Patent: May 12, 2009

(54) SHIELDED CONNECTOR

(75) Inventors: Shinyu Nagashima, Yokkaichi (JP); Fumiyoshi Tanigawa, Yokkaichi (JP); Hiroshi Hikari, Toyota (JP)

(73) Assignees: Sumitomo Wiring Systems, Ltd (JP); Kyoho Machine Works, Ltd (JP)

( * ) Notice: Subject to any disclaimer, the term of this patent is extended or adjusted under 35 U.S.C. 154(b) by 0 days.

(21) Appl. No.: 12/104,541

(22) Filed: Apr. 17, 2008

(65) Prior Publication Data

US 2008/0261452 A1 Oct. 23, 2008

(30) Foreign Application Priority Data

Apr. 18, 2007 (JP) ..... 2007-109268

(51) Int. Cl.
*H01R 9/03* (2006.01)

(52) U.S. Cl. ..... 439/610

(58) Field of Classification Search ..... 439/610
See application file for complete search history.

(56) References Cited

U.S. PATENT DOCUMENTS 4,911,660 A * 3/1990 Alf et al. ..... 439/585
4,963,104 A * 10/1990 Dickie ..... 439/610
5,358,428 A * 10/1994 Bixler et al. ..... 439/607
5,961,351 A * 10/1999 Wu ..... 439/610
6,203,377 B1 * 3/2001 Grek et al. ..... 439/610
6,929,512 B2 * 8/2005 Lai ..... 439/610

FOREIGN PATENT DOCUMENTS

JP 2006-310139 11/2006

* cited by examiner

*Primary Examiner*—Briggitte R Hammond
(74) *Attorney, Agent, or Firm*—Gerald E. Hespos; Anthony J. Casella

(57) ABSTRACT

A shielded connector is provided with a housing (14) for accommodating terminals (13) connected with ends of wires (11), a shield shell (20) for accommodating the housing (14) and connection for connecting an end portion of a shielding member (12) with the shield shell (20). The connection includes a tubular inner ring (25) into which the wires (11) are insertable and around which the end portion of the shielding member (12) is mounted, and an outer ring (29) to be crimped into connection with the outer circumferential surface of the inner ring (25) by sandwiching the end portion of the shielding member (12) between the inner ring (25) and the outer ring (29). The inner ring (25) and the shield shell (20) are integrally formed via a joint (26).

15 Claims, 11 Drawing Sheets

SHIELDED CONNECTOR

BACKGROUND OF THE INVENTION

1. Field of the Invention

The invention relates to a shielded connector.

2. Description of the Related Art

Japanese Unexamined Patent Publication No. 2006-310139 discloses a shielded connector to be connected with an end of a shielded conductor path. The shielded conductor path is formed by surrounding a plurality of wires with a shielding member made of a braided wire. The shielded connector has a housing for accommodating terminals connected with ends of wires. A shield shell accommodates the housing and connecting means for connecting an end of the shielding member with the shield shell.

This connecting means includes inner and outer rings. The inner ring is disposed so that the end of the braided member is mounted on the outer circumferential surface of the inner ring. The outer ring is disposed to be crimped into connection with the outer circumferential surface of the inner ring with the end of the braided member sandwiched between the inner and outer rings.

The shield shell includes two crimping pieces for fixing the connecting means to the shield shell. The crimping pieces are crimped into connection with the outer circumferential surface of the outer ring. Thus, the connecting means is fixed to the shield shell, and the braided member is secured electrically to the shield shell.

The outer and inner rings of the above-described construction need to be positioned between the two crimping pieces and crimped again after the outer ring is crimped into connection with the inner ring. Thus, two crimping steps are necessary, thereby presenting a problem of excess time and labor.

The invention was developed in view of the above situation and an object thereof is to provide a shielded connector in which a shielding member and a shield shell can be secured easily.

SUMMARY OF THE INVENTION

The invention relates to a shielded connector to be connected with an end of a shielded conductor path. The shielded conductor path includes one or more wires and a shielding member collectively shielding the wires. The shielded connector comprises a housing for accommodating one or more terminals connectable with the respective wires. The shield connector also has a shield shell for accommodating the housing, and connecting means for connecting an end of the shielding member with the shield shell. The connecting means includes a tubular inner ring for receiving the wires and on which the shielding member is mountable. The connecting means also includes an outer ring to be connected with the inner ring by sandwiching the shielding member between the inner and outer rings. The inner ring and the shield shell are formed integrally or unitarily via at least one joint. The shielding member and the shield shell can be secured easily to each other since it is not necessary to fix the connecting means to the shield shell.

The outer ring preferably is to be crimped into connection with the outer circumferential surface of the inner ring by sandwiching the end portion of the shielding member between the inner ring and the outer ring.

At least one projection preferably projects substantially radially out, and the shield shell is formed with at least one insertion hole for receiving the projection. The projection preferably is at a position of the inner ring substantially opposite to the joint in a radial direction. Thus, displacements of the inner ring with respect to the shield shell are prevented at this position. As a result, even if a force acts on the inner ring, for example, when the shielded conductor path is pulled, the joint will not bend in the draw-out direction of the shielded conductor path to incline the inner ring.

At least one recess preferably is recessed inwardly in the shield shell at the periphery of the insertion hole in the shield shell. Thus, the projecting distance of the projection from the shield shell can be suppressed even if a sufficient margin of engagement is ensured by causing the projection to project from the insertion hole. Therefore, inclination of the inner ring can be prevented while outer dimensions of the shielded connector are suppressed.

The projection preferably has a projecting distance to project outwardly of the shield shell from the insertion hole. Preferably more than about one third of the projection projects out from the insertion hole.

The projection preferably projects into the recess to a radial position less than or substantially equal to radially outer position of the shield shell.

Part of the projection at the outer side of the insertion hole may be bent at an angle to a draw-out direction of the shielded conductor path to extend along a peripheral part of the insertion hole. Accordingly, the joint will not bend in the draw-out direction of the shielded conductor path to incline the inner ring.

The shield shell preferably is shaped to mount up to the connecting means and is formed with at least one draw-out opening through which the shielded conductor path can be drawn out. At least one edge of the draw-out opening preferably is folded back into a folded portion.

The shield shell may be shaped to mount up to the connecting means and may be formed with a draw-out opening through which the shielded conductor path is drawn. An edge of the draw-out opening may be folded back. Thus, the edge of the cut surface of the draw-out opening will not contact and damage the shielded conductor path. Furthermore, a shielded connector is provided in which the shielding member and the shield shell easily can be secured to each other.

These and other features of the invention will become more apparent upon reading the following detailed description of preferred embodiments and accompanying drawings. It should be understood that even though embodiments are separately described, single features may be combined to additional embodiments.

DETAILED DESCRIPTION OF THE PREFERRED EMBODIMENTS

Figure 1:
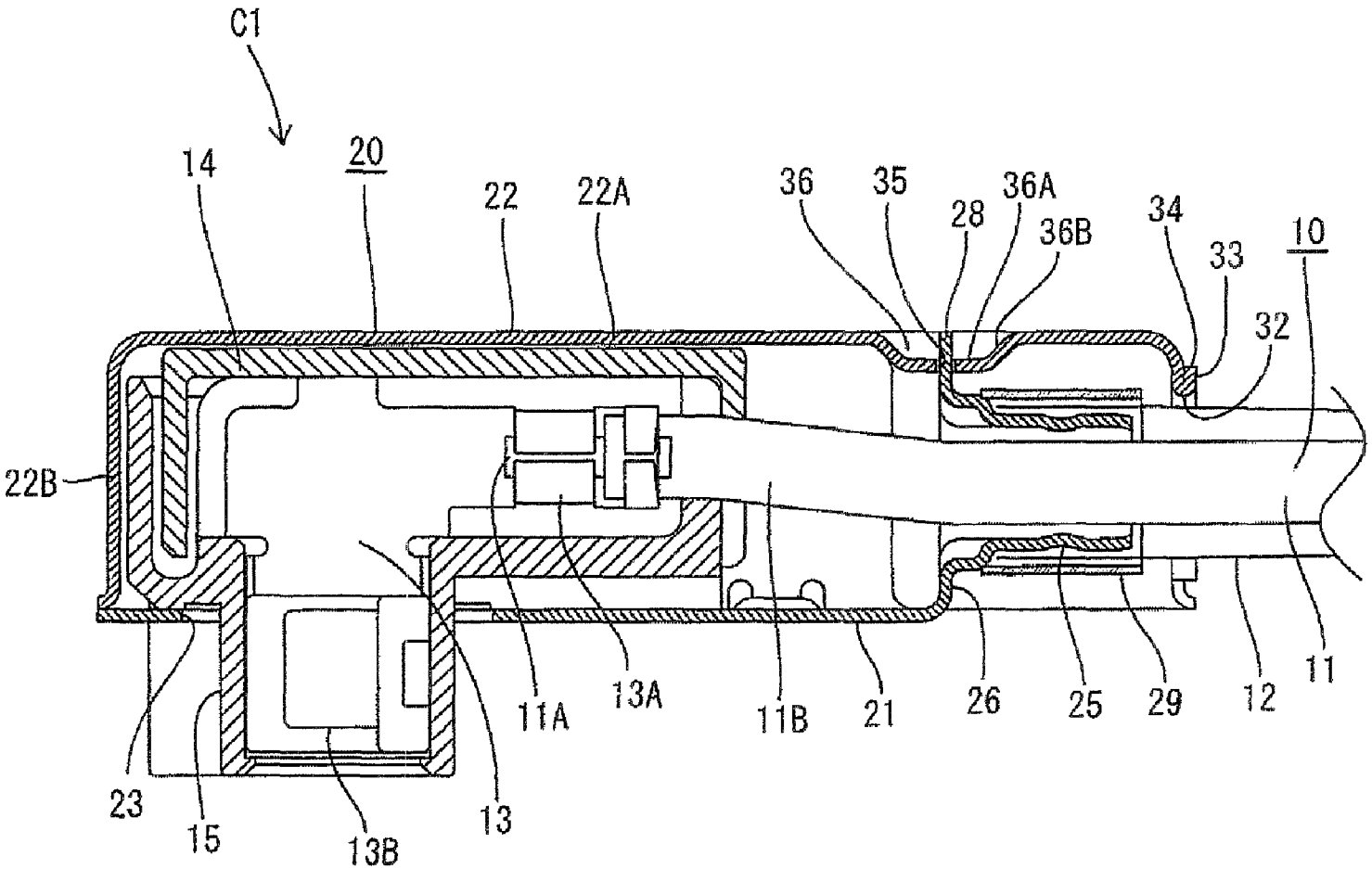
FIG. 1 is a side sectional view of a shielded connector of a first embodiment.

A shielded connector in accordance with a first embodiment of the invention is identified as C1 in FIGS. 1 to 9. The shielded connector C1 is connected with an end of a shielded conductor path comprised of wires 11 and a shielding member 12 collectively surrounding the wires 11. in the following description of the respective parts, left and right sides of FIG. 1 are referred to as front and back ends and upper and lower sides of FIG. 1 are referred to as the top and bottom.

The wires 11 are non-shielded and have a conductor 11A covered with an insulation coating 11*b* made e.g. of a synthetic resin. The shielding member 12 is substantially tubular and is formed by braiding a thin metallic wire into a mesh. The braided wire is surrounded by a protection tube (not shown) made e.g. of a synthetic resin for protection. However, the shielding member 12 may comprise a conductive layer, such as a conductive film, surrounding the wires 11. The wires 11 are shielded collectively by being inserted into the shielding member 12.

Figure 2:
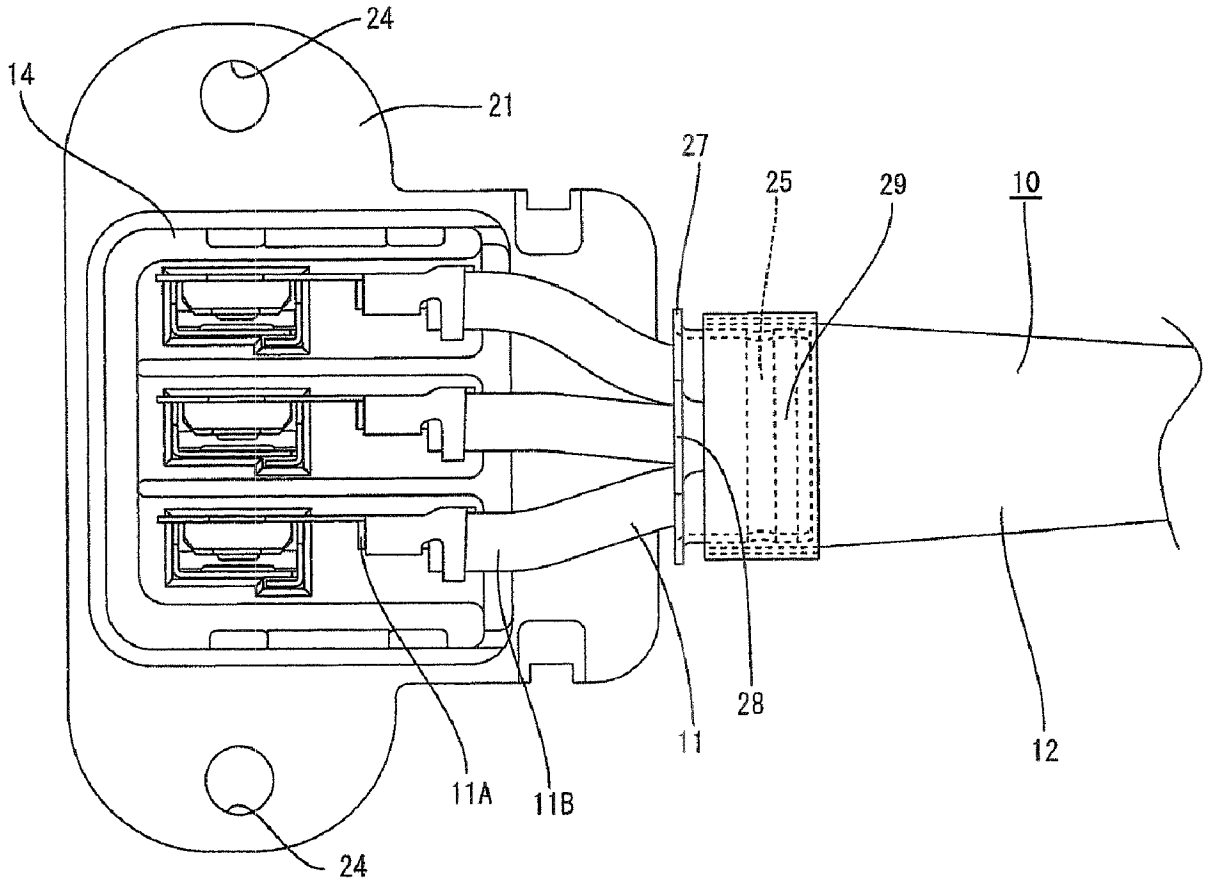
FIG. 2 is a plan view of the shielded connector showing a state before a cover is mounted.

As shown in FIG. 2, ends of the three wires 11 are drawn out from the leading end of the shielding member 12, and the insulation coatings 11B are stripped off at portions of the wires 11 adjacent the ends to expose the conductors 11A.

The connector C1 also has terminals 13 connected with the exposed ends of the wires 11. Each terminal 13 has a wire connecting portion 13A and a terminal connecting portion 13B arranged substantially perpendicular to one another to define an L-shape. The wire connecting portion 13A is to be connected with the end of the wire 11 and the terminal connecting portion 13B is connected with connectable with a mating terminal (not shown).

The shielded connector C1 has a housing 14 made e.g. of a synthetic resin and configured for accommodating the terminals 13. More particularly, the housing 14 has a connector connecting portion 15 for receiving the terminal connecting portions 13B of the terminals 13. The connector connecting portion 15 can be mated with an unillustrated mating connector so that the terminals 13 are connected electrically with terminals of the mating connector. The wires 11 connected with the terminals 13 are drawn out backward from the housing 14 in a direction substantially normal to the connecting direction of the shielded connector C1 with the mating connector.

The housing 14 of the shielded connector C1 is held in and shielded by a conductive metallic shield shell 20. The shield shell 20 has a substantially flat base plate 21 and a cover 22 opposed to the base plate 21. The housing 14 is placed on the upper surface of the base plate 21 and covered by the cover 22.

Figure 3:
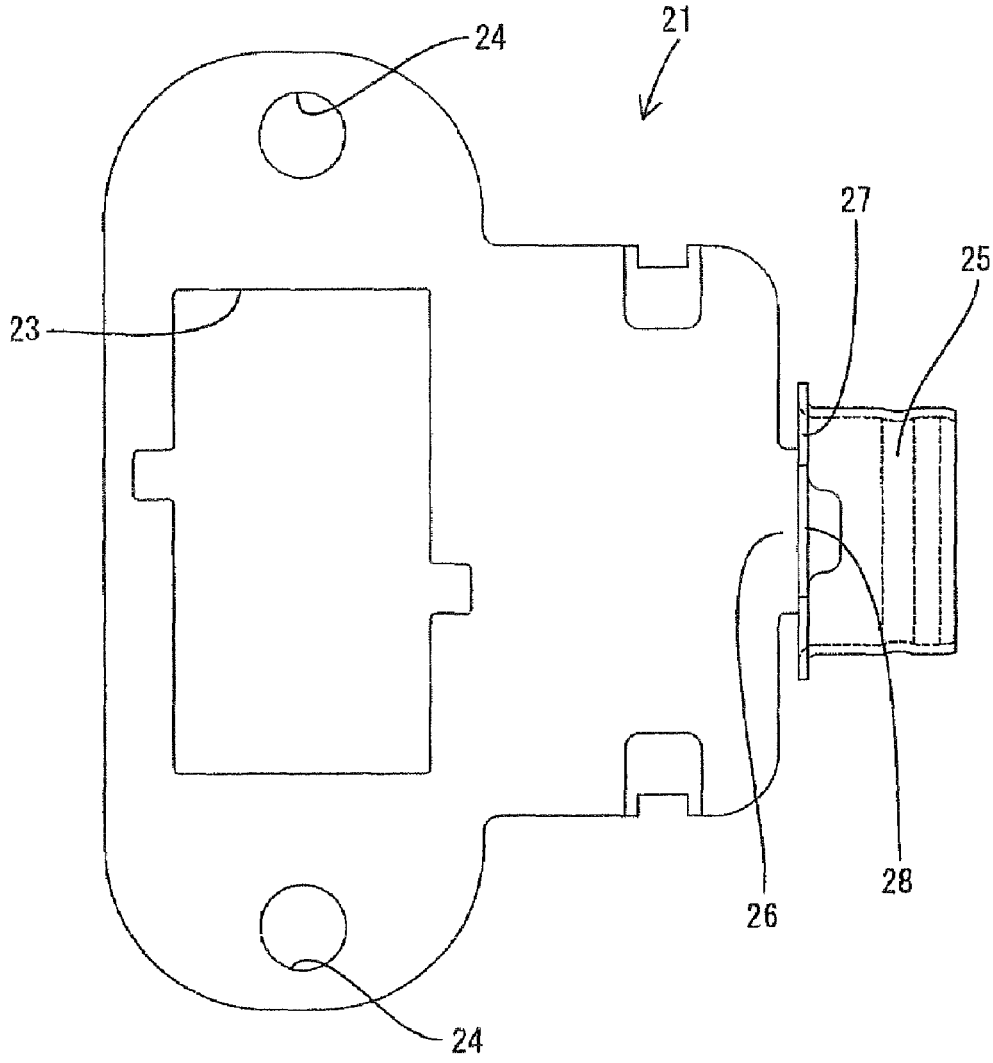
FIG. 3 is a plan view of a base plate.

A substantially rectangular fitting opening 23 is formed in a front part of the base plate 21, as shown in FIG. 3, and the connector connecting portion 15 of the housing 14 projects through the fitting opening 23, as shown in FIG. 1. Parts of the base plate 21 at opposite sides of the fitting opening 23 bulge out sideways, and mount holes 24 are formed in these bulges.

An inner ring 25 is provided at the rear end of the base plate 21 and forms a connecting means for connecting the end portion of the shielding member 12 and the shield shell 20. A joint 26 extends unitarily between the inner ring 25 and the rear end of the base plate 21 (see FIGS. 3 and 4).

Figure 5:
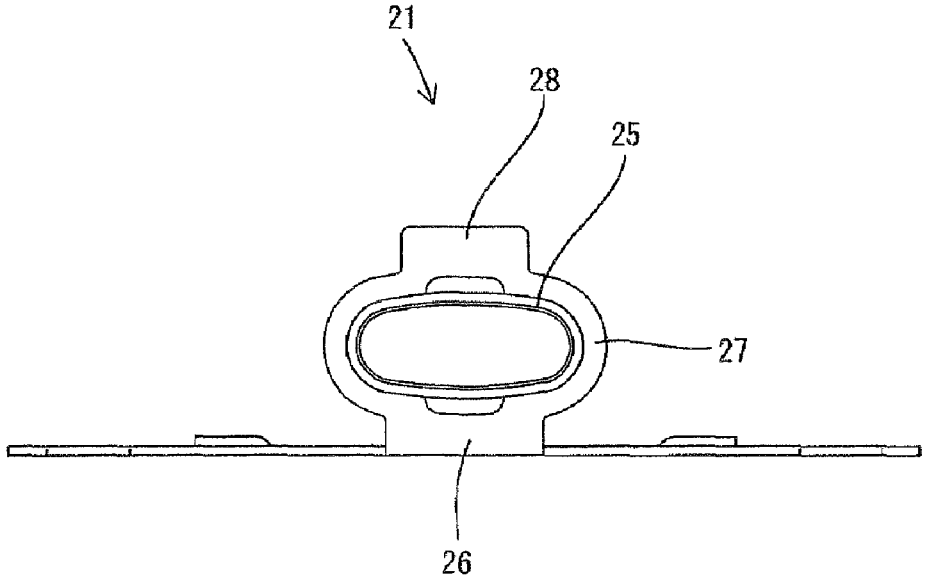
FIG. 5 is a rear view of the base plate.

As shown in FIG. 5, the inner ring 25 is a substantially elliptical tube that is slightly longer in the width direction. The wires 11 are insertable into the inner ring 25, and the end portion of the shielding member 12 is mounted on the outer peripheral surface of the inner ring 25. A jaw 27 bulges radially out at the front end of the inner ring 25 and extends around substantially the entire periphery.

Figure 4:
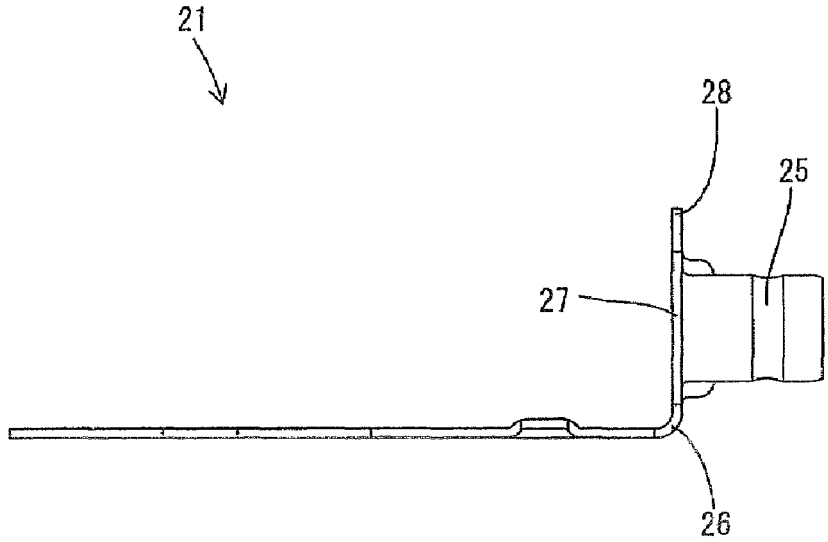
FIG. 4 is a side view of the base plate.

The joint 26 extends unitarily from the straight section at the bottom of the jaw 27 and is bent substantially perpendicularly at a position slightly behind the rear end of the base plate 21 (see FIGS. 4 and 5). Thus, the inner ring 25 projects unitarily back from the joint 26 at a position displaced up from the plane of the base plate 21. The inner ring 25 is arranged so that its central axis is substantially parallel to the plane of the base plate 21 Thus, the wires 11 are drawn out backward from the housing 14 and through the inner ring 25 without being bent significantly in the vertical direction see FIG. 1).

A projection 28 is formed at a peripheral position on the jaw 27 of the inner ring 25 substantially opposite the joint 26 and projects from the jaw 27 a distance slightly greater than the height or radial dimension of the joint 26. Thus, the projecting end of the projection 28 is at substantially the same height or radial position as the cover 22 when the cover 22 and the base plate 21 are assembled.

A conductive metallic outer ring 29 is crimped, bent or folded into connection with the outer peripheral surface of the inner ring 25. The outer ring 29 cooperates with the inner ring 25 to form at least part of the connecting means together. The end portion of the shielding member 12 is sandwiched between the inner and outer rings 25, 29 when the outer ring 29 is connected.

The cover 22 has a lid 22A and a side wall 22B that projects down from the outer periphery of the lid 22A to define an open bottom. The lid 22A and the side wall 22B are configured to cover the base plate 21 and the inner ring 25. A projecting dimension of the side wall 22B from the lid 22A substantially equals the height of the base plate 21 from the joint 26 to the projection 28. Additionally, the projecting dimension of the side wall 22B from the lid 22A enables the entire housing 14 to be accommodated between and shielded by the base plate 21 and the cover 22.

Mount holes 31 are formed in parts of the cover 22 that bulge out laterally at positions near the front end of the cover 22 and align with the mount holes 24 of the base plate 21 when the base plate 21 and the cover 22 are assembled.

Figure 7:
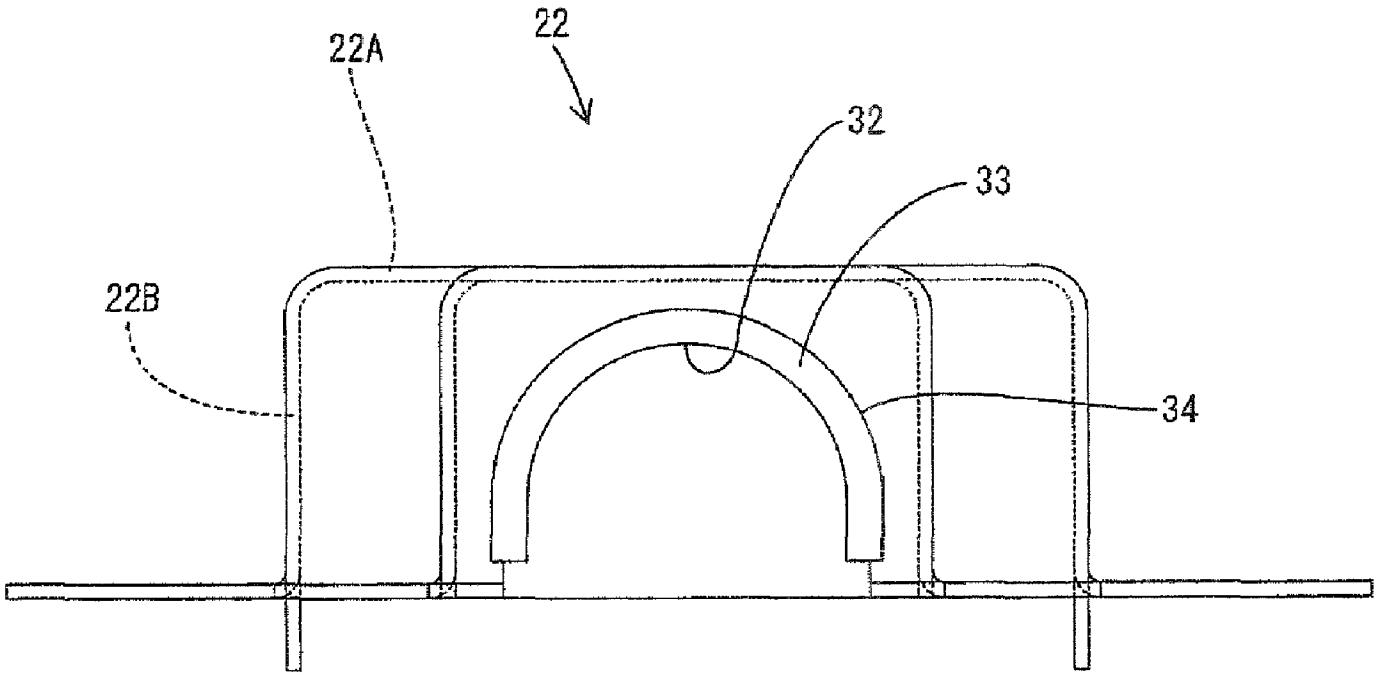
FIG. 7 is a rear view of the cover.
Figure 8:
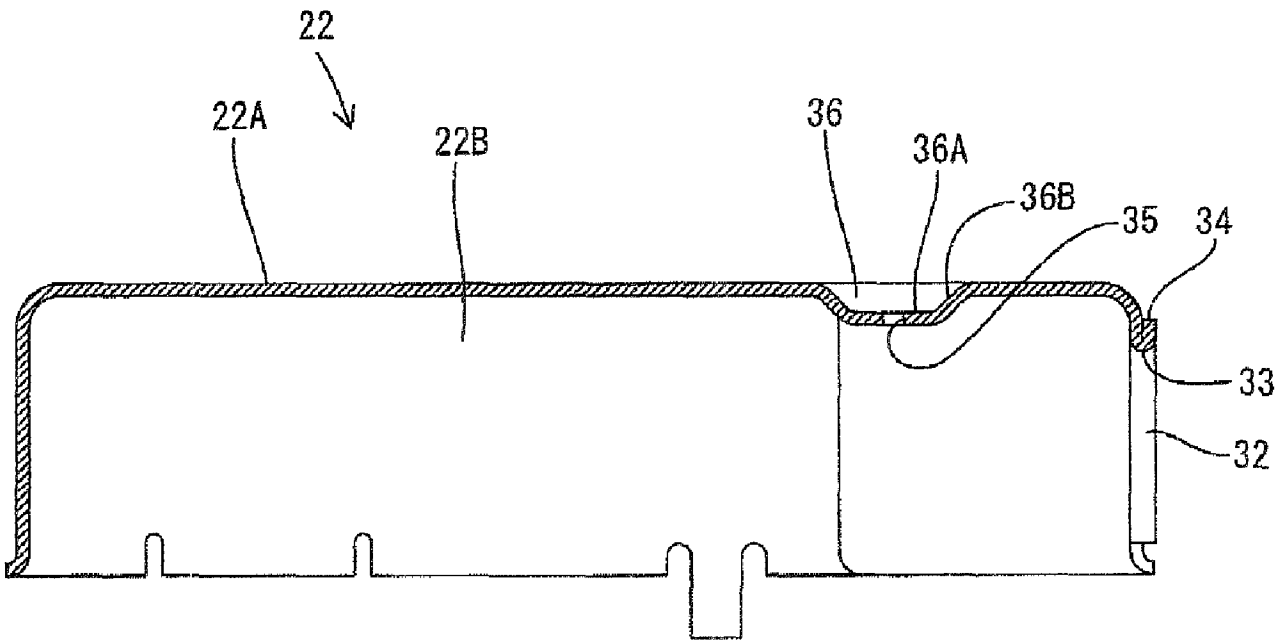
FIG. 8 is a side view in section of the cover.
Figure 9:
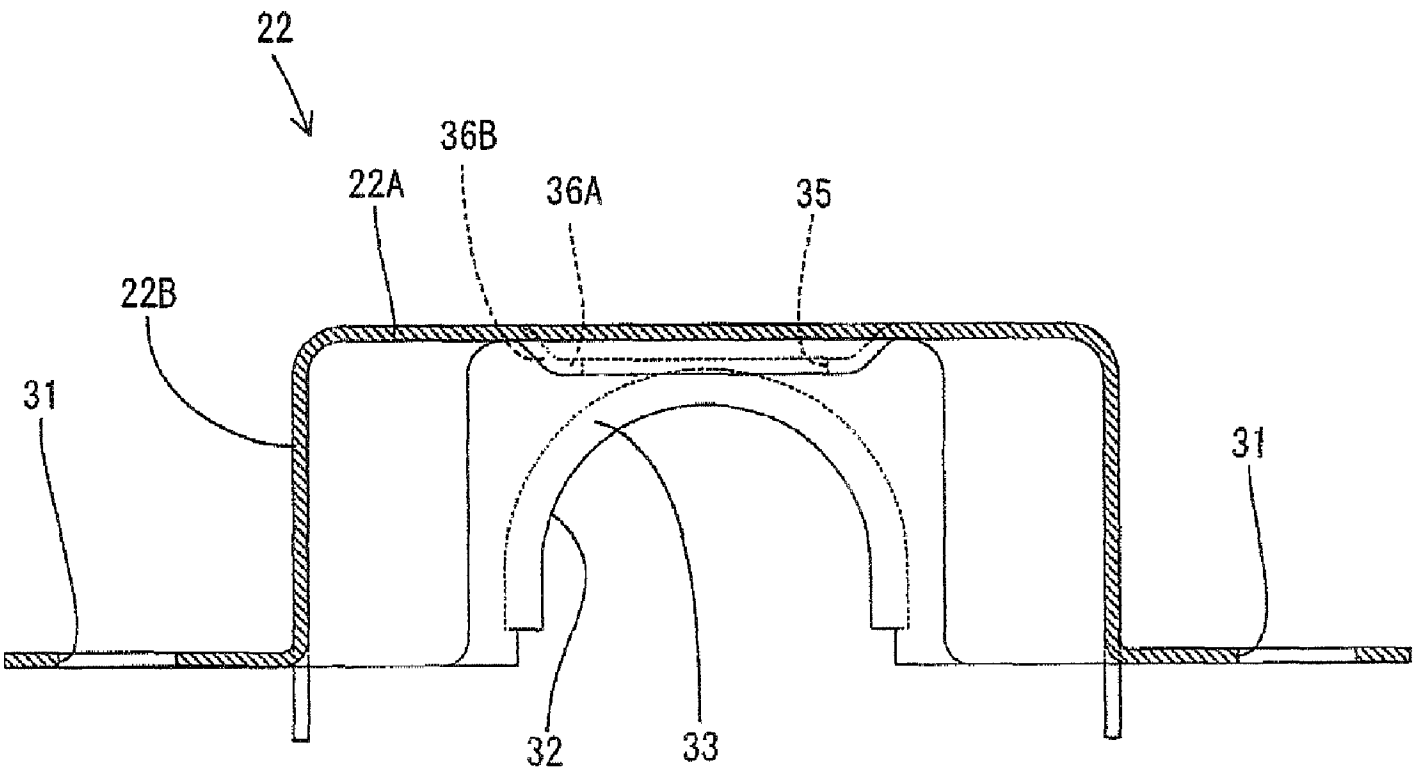
FIG. 9 is a section of the cover plate.

A draw-out opening 32 is formed at the rear end of the side wall 22*b* of the cover 22 and enable the wires 11 having passed through the inner ring 25 and the shielding member 12 secured to the outer peripheral surface of the inner ring 25 (i.e. shielded conductor path 10) to be drawn out backward. As shown in FIG. 7, the draw-out opening 324 has a substantially semicircullar cross section with an open bottom. A flange 33 is folded back at a portion of the cover 22 adjacent the draw-out opening 32 and closely contacts the outer surface of the rear part of the side wall 22B. Thus, a cut edge of the flange 33 faces away the shielded conductor path 10.

An insertion hole 35 is formed in the lid 22A of the cover 22 at a position corresponding to the projection 28 of the inner ring 25. The insertion hole 35 is a narrow slit extending in the width direction (see FIG. 6) and is dimensioned for closely receiving the projection 28 (see FIG. 1).

Figure 6:
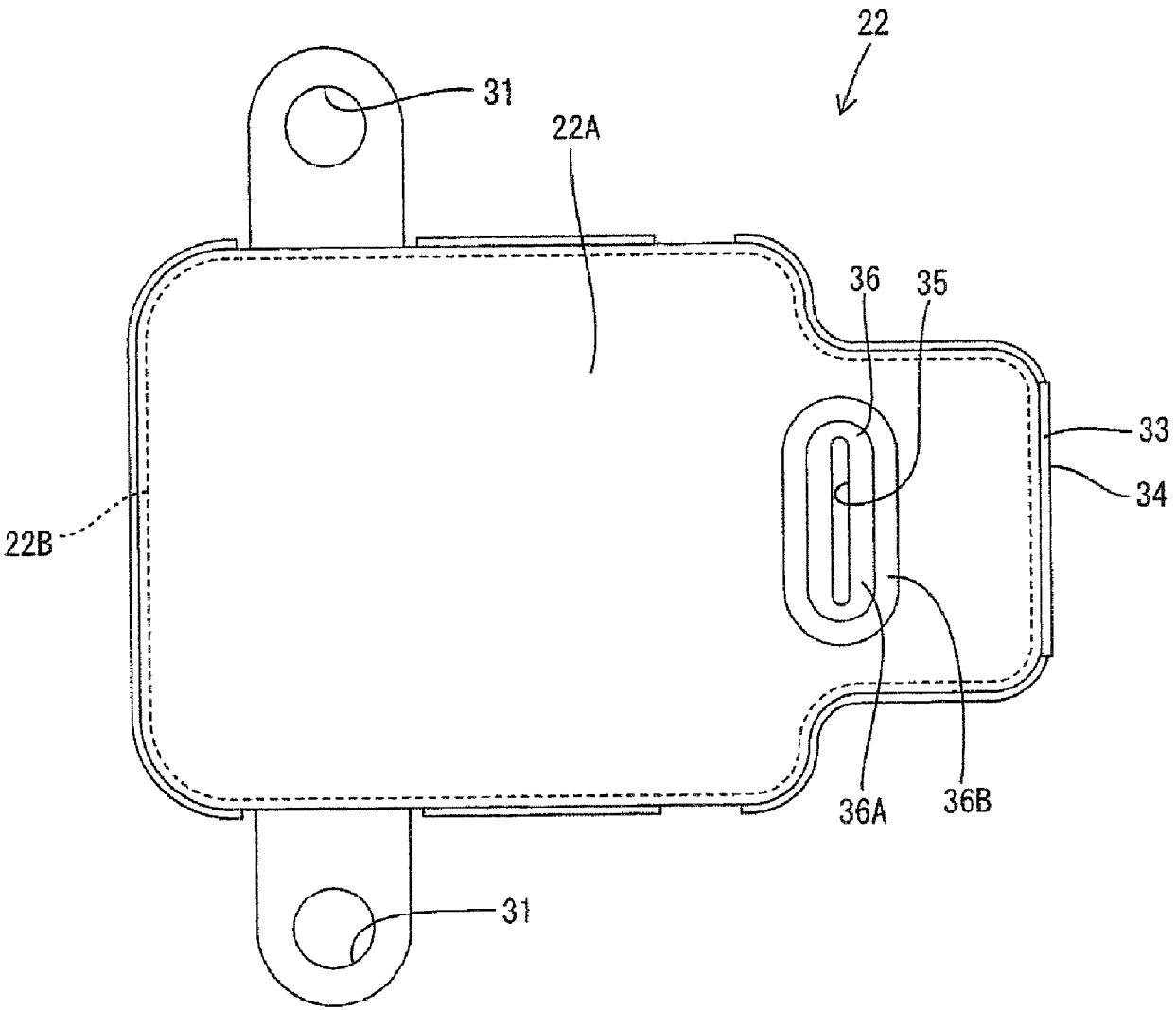
FIG. 6 is a plan view of the cover.

A recess 36 is formed in an area of the lid 22A surrounding the insertion hole 35 and projects more inward than the other parts of the shield shell 20. The recess 36 has a bottom section 36A that extends substantially parallel to portions of the lid 22A adjacent the recess 36. The bottom section 36A defines an innermost part of the recess 36. The recess 36 also has an oblique section 36B that slopes up from the bottom section 36A. The depth of the recess 36 is substantially half the vertical dimension of the projection 28 (see FIG. 1). Specifically, the projection 28 passes through the insertion hole 35 when the cover 22 is assembled to the base plate 21 and the vertical center of the projection 28 substantially aligns with the bottom section 36A of the recess 36. Accordingly, substantially the outer half of the projection 28 projects out beyond the insertion hole 35. The projecting end of the projection 28 aligns substantially with the outer surface of the lid 22A. As shown in FIG. 6, the insertion hole 35 is substantially at a central position of the bottom section 36A of the recess 36 in forward and backward directions and/or width direction.

The shielded connector C1 is assembled by first inserting the wires 11 into the inner ring 25 and then mounting the shielding member 12 on the outer peripheral surface of the inner ring 25. The outer ring 29 then is crimped, bent or folded into connection with the outer peripheral surface of the inner ring 25 to sandwich and secure the melding member 1 between the two rings 25, 29. in this way, the shielding member 12 is connected electrically and fixed to the shield shell 20 via the inner ring 25 (see FIG. 2).

The terminals 13 connected with the ends of the wires 11 then are accommodated in the housing 14, and the housing 14 is mounted on the cover plate 22 to fit the connector connecting portion 15 into the fitting opening 23. The cover 22 then is mounted from above to assemble the cover 22 and the base plate 21, thereby completing the assembly of the shielded connector C1.

The inner ring 25 is unitary with the base plate 21. Hence, only one connecting step is needed for connecting the outer ring 29 and fixing the shielding member 12 to the shield shell 20. The two crimping steps of the prior art are not required, thereby saving significant time and labor. Further, the joint 26 holds the inner ring 25 at the specified position with respect to the base plate 21, and it is not necessary to position the inner ring 25 with respect to the base plate 21 as before and the shielding member 12 and the shield shell 20 can be secured very easily.

The shielded connector C1 is connected with the mating connector (not shown) provided, for example, in a motor or in an engine compartment and the mount holes 24, 31 of the shield shell 20 are fixed with screws or bolts. Thus, the shielded connector C1 is fixed and grounded to a wall or the like of the unillustrated motor or engine compartment. The inner ring 25 and the base plate 21 are formed unitarily, and therefore the shielding member 12 and a grounding member (wall portion of the motor) reliably can be kept connected.

A backward force could act on the inner ring 25 if, for example, the shielded conductor path 10 is pulled. Thus, the inner ring 25 tries to move backward with the joint 26 as a supporting point. However, the projection 28 contacts the edge of the insertion hole 35 to prevent a displacement of the inner ring 25. Accordingly, the joint 26 will not be bend back in the draw-out direction of the shielded conductor path 10 and the inner ring 25 will not incline even if a force acts on the inner ring 25, for example, when the shielded conductor path 10 is pulled.

The upper portion (more than about one third, more preferably the upper half) of the projecting piece 28 projects out from the insertion hole 35 to ensure a sufficient margin of engagement so that the projecting piece 28 does not come out of the insertion hole 35. Additionally, the insertion hole 35 is in the recess 36 so that the projecting piece 28 does not project out from the cover 22. Therefore, the inclination of the inner ring 25 is prevented reliably without increasing the height of the shielded connector C1.

The shielded conductor path 10 might be bent into contact with the edge of the draw-out opening 32 of the shield shell 20. However, folded flange 33 prevents contact of the cut edge 34 with the shielded conductor path 10. As a result, the shielded conductor path 10 will not be damaged. There is no need to attach a protecting member along the cut surface to prevent damage to the shielded conductor path 10 as in the prior art, and the number of parts can be reduced. It should be noted that unillustrated taping or thinning is or may be applied to a part of the shielded conductor path 10 from the front end of an unillustrated protection tube to the outer peripheral surface of the outer ring 29.

As described above, the inner ring 25 and the shield shell 20 are formed unitarily formed via the joint 26 according to this embodiment. Thus, it is not necessary to fix the inner ring 25 separately to the shield shell 20, and the shielding member 12 and the shield shell 20 easily can be secured together. Further, the number of parts can be reduced as compared to the case where the inner ring 25 and the shield shell 20 are separate parts.

Displacement of the inner ring 25 with respect to the shield shell 20 are prevented by inserting the projection 28 into the insertion hole 35 at the position of the inner ring 25 substantially opposite to the joint 26. Thus, the joint 26 will not bend in the draw-out direction of the shielded conductor path 10 and the inner ring 25 will not incline even if a force acts on the inner ring, for example, when the shielded conductor path 10 is pulled.

Figure 10:
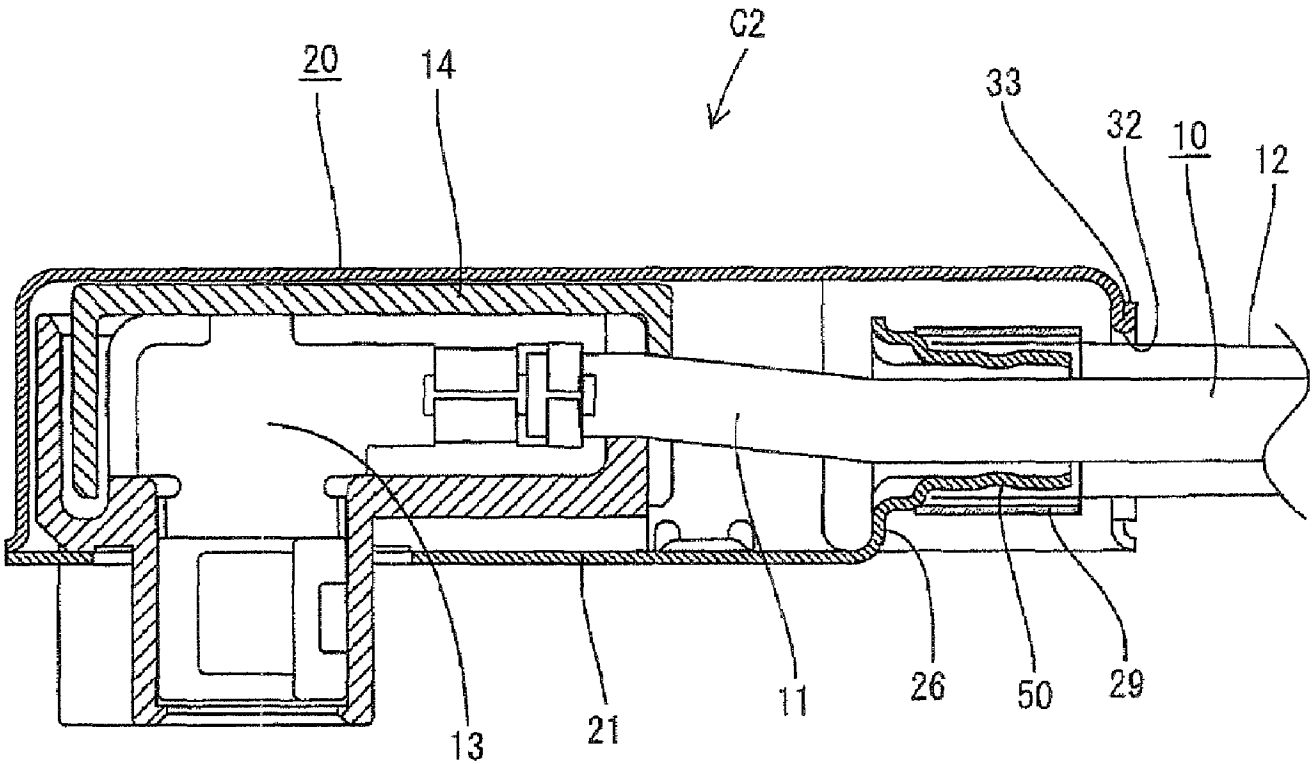
FIG. 10 is a side view in section of a shielded connector according to a second embodiment.

A shielded connector C2 according to a second preferred embodiment of the invention is described with reference to FIG. 10. The shielded connector C2 of this embodiment differs from the first embodiment in that an inner ring 50 includes no projection. It should be noted that the similar or same construction as in the first embodiment is identified by the same reference numerals but is not described.

The inner ring 50 for connecting an end portion of a shielding member 12 is formed unitarily at the rear end of a base plate 21 via a joint 26. Thus, it is not necessary to fix the inner ring 50 separately to a shield shell 20 and the shielding member 12 and the shield shell 20 can be secured easily to each other similar to the first embodiment. Further, the number of parts is reduced as compared to the case where the inner ring 50 and the shield shell 20 are separate parts.

Figure 11:
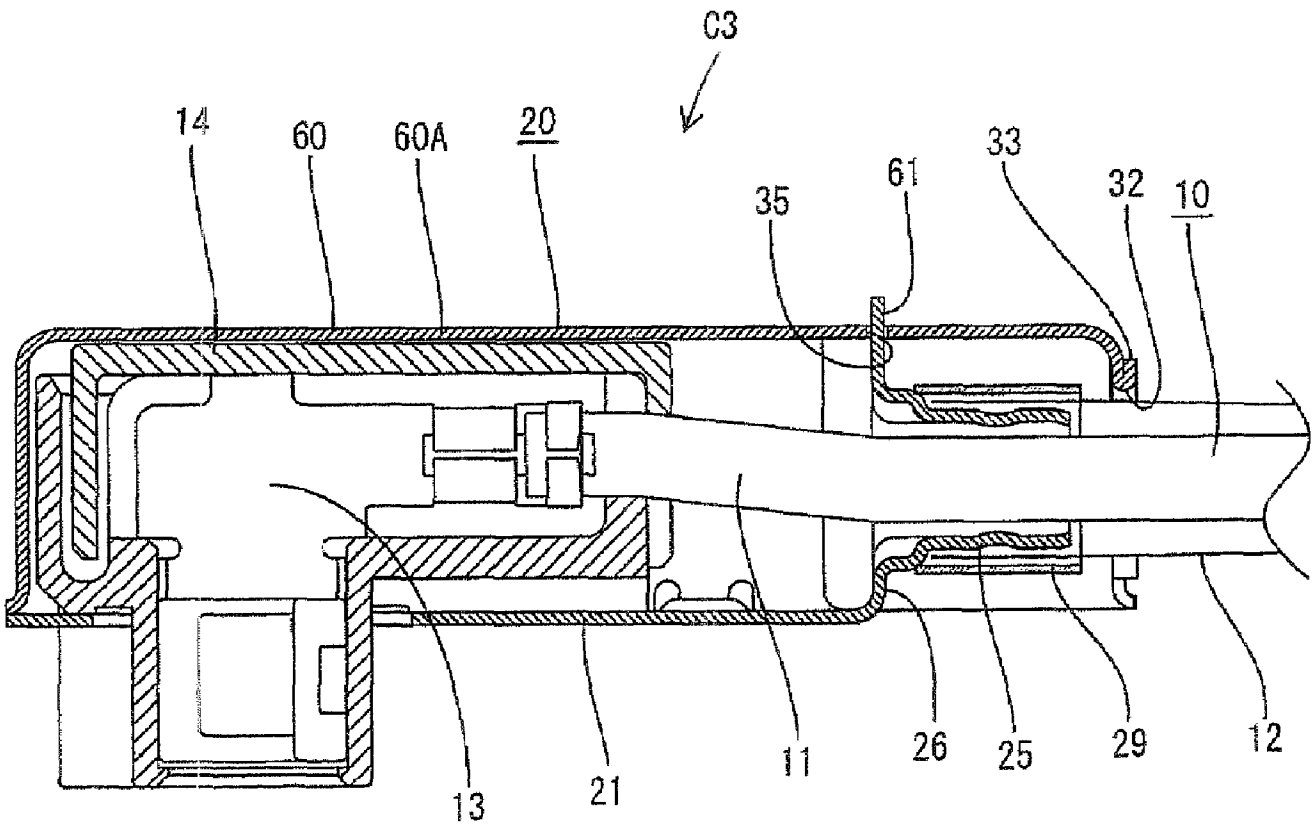
FIG. 11 is a side view in section of a shielded connector according to a third embodiment.

A shielded connector C3 according to a third embodiment of the present invention is described with reference to FIG. 11. The shielded connector C3 differs from the first embodiment in that a cover plate 60 includes no recess. It should be noted that the similar or same construction as in the first embodiment is identified by the same reference numerals and is not described.

In the shielded connector C3, an inner ring 25 is formed unitarily at the rear end of a base plate 21 via at least one joint 26 and includes a projection 61 that projects out similar to the first embodiment. A vertical dimension of the projection 61 is set such that the projection 61 projects out from a lid 60A of a cover 60.

The cover 60 is formed with an insertion hole 35, into which the respective projecting piece 61 of the inner ring 25 is inserted when the cover 60 and the base plate 21 are assembled. Thus, an upper part of the projection 61 (preferably having a substantially equal vertical dimension as in the first embodiment) projects out from the insertion hole 35.

As described above, the inner ring 25 is formed unitarily at the rear end of) the base plate 21 similar to the first embodiment. Thus, it is not necessary to fix a separately inner ring 25 to the shield shell 20 and a shielding member 12 and a shield shell 20 can be secured easily to each other.

Displacements of the inner ring 25 with respect to the shield shell 20 can be prevented by inserting the projecting piece 61 into the insertion hole 35. Thus, even if a force acts on the inner ring 25, for example, when the shielded conductor path 10 is pulled, the joint 26 will not bend in a draw-out direction of a shielded conductor path and the inner ring 25 will not incline.

Figure 12:
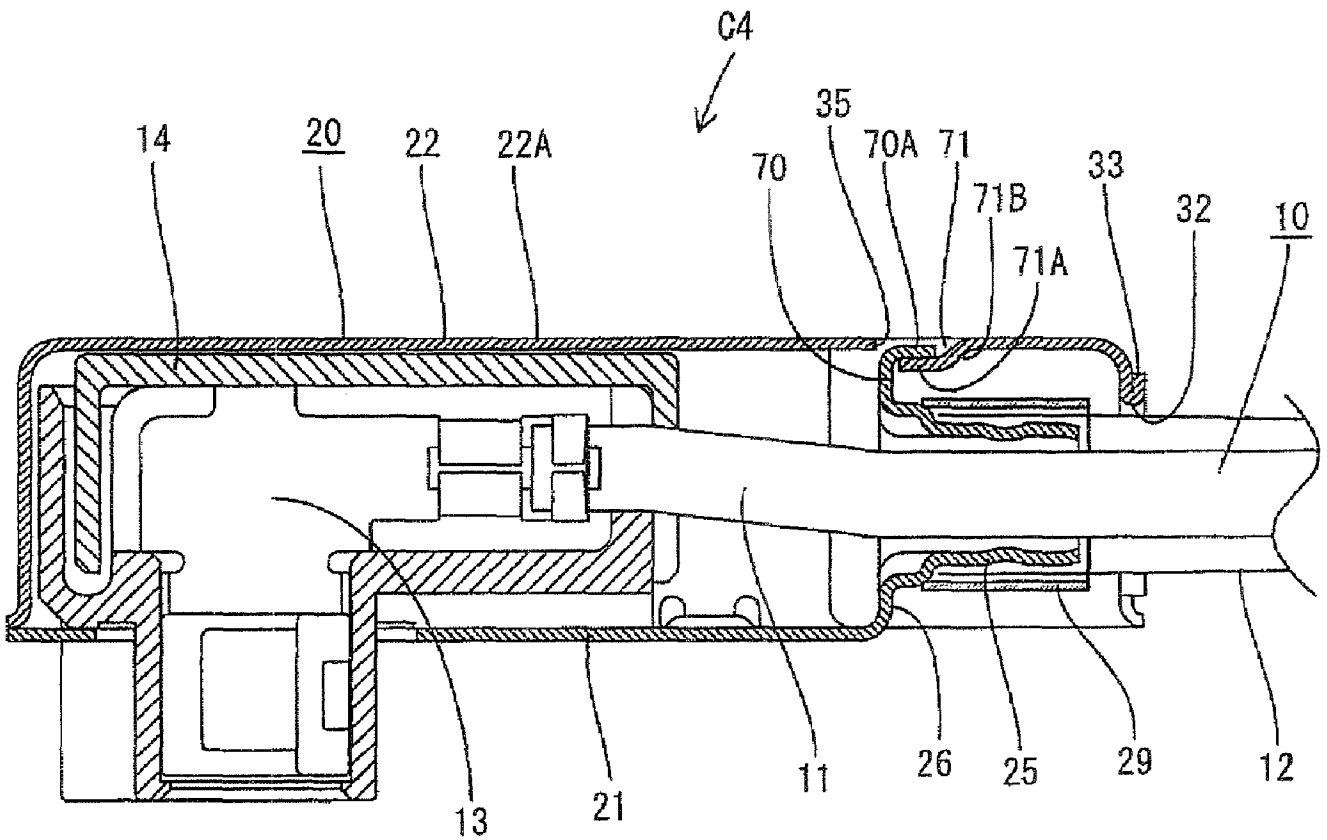
FIG. 12 is a side view in section of a shielded connector according to a fourth embodiment.

A shielded connector C4 according to a fourth embodiment of the present invention is described with reference to FIG. 12 The shielded connector C4 of this embodiment differs from the first embodiment in that a projecting piece 70 has a bent shape. It should be noted that the similar or same construction as in the first embodiment is identified by the same reference numerals and is not described.

The shielded connector C4 has an inner ring 25 formed unitarily at the rear end of a base plate 21 via at least one joint 26 and includes a projection 70 similar to the first embodiment. The projection 70 has a vertical dimension set to project out from a lid 22A of a cover 22.

The lid 22A of the cover 22 is formed with an insertion hole 35 for receiving the projection 70 of the inner ring 25. A recess 71 is formed at a rear edge of the insertion hole 35 The recess 71 has a bottom section 71A located at the lowest position and substantially parallel to the lid 22A and an oblique section 71B inclined out from the bottom section 71A. The depth of the recess 71 is slightly larger than the thickness of the cover 22.

A part 70A of the projection 70 inserted through the insertion hole 35 is bent backward substantially in the draw-out direction of a shielded conductor path 10 to extend substantially along the outer surface of the bottom section 71A of the recess 71. The bent portion 70A of the projection 70 is within the depth of the recess 71 and does not project up from the lid 22A.

As described above, in this embodiment, the inner ring 25 is formed unitarily at the rear end of the base plate 21 similar to the first embodiment. Thus, it is not necessary to fix the inner ring 25 to the shield shell 20 and a shielding member 12 and the shield shell 20 can be secured easily to each other.

Displacements of the inner ring 25 with respect to the shield shell 20 are prevented by inserting the projection 70 into the insertion hole 35. Thus, similar to the first embodiment, the joint 26 cannot be bent in the draw-out direction of the shielded conductor path and the inner ring 25 will not incline even if a force act on the inner ring 25, for example, when the shielded conductor path 10 is pulled.

Further, the bent portion 70A of the projecting piece 70 at the outer side of the insertion hole 35 comes into surface contact with the bottom section 71A of the recess 71 at the periphery of the insertion hole 35 in response to a force for bending the joint 26 backward. Thus, relative displacements of the inner ring 25 are prevented reliably even if a relatively large force acts on the inner ring 25. Therefore, an outward inclination of the inner ring 25 is prevented more reliably.

The invention is not limited to the above described embodiments, and the following embodiments also are embraced by the scope of the invention.

Although the projection 28 (61) project out from the insertion hole 35 in the first and third embodiments, the invention is not limited to this and the projections may be arranged so that the upper ends are in the insertion hole.

Although the bent portion 70A of the projection 70 is bent backward along the bottom section 71A of the recess 71 in the fourth embodiment, the invention is not so limited and the bent portion of the projection may be bent forward or arranged along the upper surface of the lid without forming the recess.

Although the shielded conductor path 10 includes the three wires 11 in the above embodiments, the invention is not so limited.

Although the inner ring 25 is continuous with the shield shell 20 at the rear end edge of the jaw 27 via the joint 26 in the above embodiments, the invention is not limited to this and the lateral edge, upper end edge of the jaw and/or a part other than the jaw may be continuous with the shield shell via the joint.

Although the inner ring 25 is integral or unitary to the base plate 21 in the above embodiments, it may be formed integral to the cover.

Although the edge of the draw-out opening 32 has the folded flange 33 in the above embodiments, the folded flange may not be provided.

Although the shield shell 20 is described as a unitary part, it may be integrally assembled of plural parts or plural shield shells 20 may be provided.

What is claimed is:

1. A shielded connector to be connected with an end of a shielded conductor path including one or more wires and a shielding member collectively shielding the wires, comprising:

a housing for accommodating one or more terminals connectable with the respective wires;

at least one shield shell for accommodating the housing; and connecting means for connecting an end portion of the shielding member with the shield shell, the connecting means including:

a tubular inner ring into which the wires are insertable and to which the shielding member is mountable, an outer ring connected with the inner ring by at least partly sandwiching the shielding member between the inner ring and the outer ring, and at least one joint extending integrally or unitarily between the inner ring and the shield shell.

2. The shielded connector of claim 1, wherein the outer ring is crimped into connection with an outer peripheral surface of the inner ring while sandwiching the end portion of the shielding member between the inner ring and the outer ring.

3. The shielded connector of claim 2, further comprising at least one outwardly extending projection, and the shield shell is formed with at least one insertion hole, into which the projection is inserted.

4. The shielded connector of claim 3, wherein the projection is provided at a position of the inner ring substantially opposite to the joint in a radial direction.

5. The shielded connector of claim 3, wherein the projection has a projecting distance to project outwardly of the shield shell from the insertion hole.

6. The shielded connector of claim 5, wherein a part of the projection at an outer side of the insertion hole is bent in a draw-out direction of the shielded conductor path to extend substantially along a peripheral part of the insertion hole.

7. The shielded connector of claim 3, wherein at least one recess is provided in the shield shell at a peripheral edge of the insertion hole.

8. The shielded connector of claim 7, wherein the projection projects into the recess, but does not project out beyond outer surface areas of portions of the shield shell adjacent the recess.

9. The shielded connector of claim 1, wherein the shield shell is shaped as to be mountable up to the connecting means and is formed with at least one draw-out opening, through which the shielded conductor path can be drawn out, and at least one edge of the draw-out opening preferably is folded back into a folded flange.

10. A shielded connector, comprising:

a conductive base plate;

a conductive cover mounted to the base plate and configured so that the base plate and the cover define a shield shell;

a housing disposed in the shield shell;

a conductive joint extending unitarily from one of the base plate and the cover;

a tubular inner ring extending unitarily from the joint; and an outer ring substantially surrounding the inner ring for sandwishing a shielding member between the inner ring and the outer ring.

11. A shielded connector comprising:

a conductive base plate;

a conductive cover mounted to the base plate and configured so that the base plate and the cover define a shield shell, the shield shell being formed with an insertion hole;

a housing disposed in the shield shell;

a conductive joint extending unitarily from one of the base plate and the cover;

a tubular inner ring extending unitarily from the joint, a projection extending out from the inner ring and into the insertion hole.

12. The shielded connector of claim 11, wherein the projection extends from a position on the tubular inner ring substantially diametrically opposite the joint.

13. The shielded connector of claim 11, wherein the projection is dimensioned to extend through the insertion hole and to a position outwardly of the shield shell.

14. The shielded connector of claim 13, wherein a part of the projection outwardly of the shield shell is bent to extend substantially along an outer surface of the shield shell.

15. The shielded connector of claim 13, wherein at least one recess is provided in portions of the shield shell surrounding the insertion hole.

* * * * *